United States Patent [19]

Leach

[11] Patent Number: 4,834,459

[45] Date of Patent: May 30, 1989

[54] BODY RESTRAINT DEVICE

[76] Inventor: Jamie S. Leach, 1325 Whispering Hills, Ada, Okla. 74820

[21] Appl. No.: 233,420

[22] Filed: Aug. 18, 1988

[51] Int. Cl.[4] ..... A47D 15/00

[52] U.S. Cl. ..... 297/467; 297/485; 297/487

[58] Field of Search ..... 297/485, 487, 467

[56] References Cited

U.S. PATENT DOCUMENTS

| | | | |
|---|---|---|---|
| 1,376,625 | 5/1921 | Johnston | 297/467 |
| 2,404,108 | 7/1946 | Stauffacher et al. | 227/49 |
| 2,495,482 | 1/1950 | Rogatz | 297/467 |
| 2,652,183 | 9/1953 | Hlivka | 297/467 |
| 3,713,692 | 1/1973 | McCracken et al. | 297/467 |
| 4,037,764 | 7/1977 | Almosnino et al. | 224/6 |
| 4,050,737 | 9/1977 | Jordan . | |
| 4,235,474 | 11/1980 | Rosenberg | 297/465 |
| 4,676,554 | 6/1987 | Harlick et al. | 297/467 |

*Primary Examiner*—Francis K. Zugel

*Attorney, Agent, or Firm*—Laney, Dougherty, Hessin & Beavers

[57] ABSTRACT

A body restraint device which includes a pair of elongated fabric waistband wings joined end-to-end to form a waistband and carrying securement elements at the free end of each of the wings. A trapezoidally-shaped fabric crotch portion is joined to the waistband at its center so that the trapezoidally-shaped crotch portion and the waistband wings collectively form a generally T-shaped fabric restraint panel. At the opposied corners of the trapezoidally-shaped crotch portion adjacent the side of the crotch portion which is spaced from, and extends parallel to, the longitudinal axis of the elongated wing portions, the crotch portion carries a pair of securing elements.

8 Claims, 1 Drawing Sheet

BODY RESTRAINT DEVICE

FIELD OF THE INVENTION

This invention relates to fabric body restraint devices for retaining infants and small children in a seated position in a high chair or the like, and also useful to restrain older persons having physical or mental infirmities causing a need for a restraint to aid them in sitting in an upright position.

BACKGROUND OF THE INVENTION

Brief Description of the Prior Art

Many restraining devices have previously been contrived for keeping infants seated upright in a high chair or other seat. The propensity of infants to wiggle in their chairs and slide down until they fall out of the chair is well known. A restraining device capable of preventing such sliding out of the chair will, of course, generally be required to have a portion of the restraint device extended through the crotch of the infant and around the waist.

Many devices have undertaken to safely and inexpensively achieve the objective of preventing the infant from sliding out of the high chair or other seat. Thus, for example, in U.S. Pat. No. 4,235,474, a harness for restraining a baby in a chair is illustrated. This harness has a body section which includes a crotch portion which extends around the buttocks of the baby and up across the abdomen. At a location near the upper end of the crotch portion where the crotch portion crosses the abodomen, the restraint device includes a pair of straps or wing portions which can be extended around the rear side of the seat and there tied together to lock the restraint device to the seat or chair, thereby preventing the infant from sliding out of the chair. The harness shown in this patent further includes a pocket which extends upwardly from the restraint device along the back of the infant, and is dimensioned to fit over the upper portion of the back of the chair. This type of harness allegedly does not restrain or impair the movement of the child's arms and legs, and the back of the infant is supported by the portion of the harness which extends from the crotch portion upwardly to the pocket which is slipped over the top of the chair.

A support harness is also illustrated and described in U.S. Pat. No. 4,050,737. In this support harness, a pair of shoulder straps are provided which extend over the infant's shoulders and are secured by Velcro straps to a tongue which projects upwardly along the back of the infant from a crotch portion which is centrally located in the fabric panel of which the harness is formed. The crotch portion carries a pair of opposed wings which include belts which can be extended around the back of the chair to secure the support harness to the chair.

In U.S. Pat. No. 4,037,764, a child carrier is disclosed by which a child may be suspended from straps which can then be carried by a parent or placed over a supporting member located above the child's head. The child carrier device shown in this patent includes a large panel which includes a portion which extends upwardly across the buttocks of the child and is engaged by large flat wings extend from an abdomen portion of the panel around the sides of the child and engage Velcro strips or other fastening elements on the rear side of the buttocks portion of the panel. There then extends upwardly from the abdomen portion of the child carrier, a pair of elongated straps which form large bights or loops located above the head of the child, by which the child can be carried when seated in the carrier.

In U.S. Pat. No. 4,676,554, an article for restraining and supporting persons in a chair is illustrated and described. The restraining article includes a heart-shaped seat portion which carries a pair of straps at two of its corners. These straps can be used to tie the seat portion to the rungs at the corners of the seat of a chair in which the device is to be used. A pair of elongated straps extend from the point of the heart-shape of the seat portion, and when the seat portion or crotch portion of this device is pulled upwardly across the genital area and to the location of the abdomen, these straps can then be extended around the sides of the body and around the rungs or back of the chair, and there tied or secured to afford the desired restraint of the body of a person sitting on the crotch portion of the article. In this device, the back of the infant or other person restrained is pulled against the rungs or structural members of the back of the chair, and thus the article is not comfortable to the person restrained.

Other devices which may be employed for restraining infants or others when they are seated in a chair are those devices which are shown in Stauffacher at al U.S. Pat. No. 2,404,108 and Johnston U.S. Pat. No. 1,376,625.

BRIEF DESCRIPTION OF THE PRESENT INVENTION

The present invention is a body restraint device which is very simple in construction, but which is effective for restraining infants or persons of any age who are impaired so as to be unable to sit erect for extended periods of time, but instead slide downwardly from a sitting position toward a prone position. Although the restraint device has its primary utility in the restraint of young children and infants, and is most frequently dimensioned for this use and for securement to high chair or similar seating structure, the device, by enlargement of its dimensions, can be used with equal facility for elderly persons and others who may be seated in wheelchairs or in full sized chairs, and require assistance to remain seated in a relatively upright position during the course of a meal, during a conversation or for other extended periods of time.

Broadly described, the present invention comprises an elongated waistband which has an inner side and an outer side. The waistband includes a pair of waistband wings joined at a central portion of the waistband in end-to-end relation, and collectively defining an upper edge which extends along one side of the restraint device. The restraint device further includes a crotch portion of trapezoidal configuration, and having an inner side and an outer side. The crotch portion includes an elongated securement edge which extends parallel to the elongated upper edge of the waistband portion. The securement edge of the crotch portion intersects, at its ends, a pair of convergent side edges which extend from the securement edge to the narrowest portion of the crotch portion. The narrowest portion of the crotch portion is joined to the central portion of the waistband. At this location, the lateral edges of the crotch portion are radiused into the pair of waistband lower edges which extend along the respective wing portions of the waistband generally parallel to the upper edge thereof.

The crotch portion and waitband of the restraint device are preferably formed of a single fabric panel which is typically of soft flexible material.

Adjacent the point where the elongated edge of the crotch portion intersects the convergent side edges of the crotch portion, the crotch portion has a pair of first fastener devices secured to the outer side thereof so that one of the fastener devices is located adjacent each of the respective ends of the elongated securement edge. On the inner side of the waistband adjacent the central portion, fastening means is provided for engaging the pair of first fastener devices so that the elongated securement edge of the crotch portion and the top edge of the waistband are placed in a generally circular array when such engagement is effected. This circular configuration of the crotch portion and a part of the waistband encircles the midriff of the person whose body is to be restrained against slipping out of a sitting position toward a prone position. After this, the wing portions of the waistband are extended around the back side of a chair in which the person is seated, and are there engaged with each other to lock both the restraint device and the person encircled thereby in a sitting position in the chair.

An important object of the present invention is to provide a relatively inexpensive, quite easily made and easily cleaned, body restraint device which can be used without special skills.

Another object of the invention is to provide a body restraint device which can be usefully employed to assist incontinent people in remaining in a sitting position, rather than slumping or sliding toward a prone position, or falling or sliding out of a chair in which they are sitting.

An additional object of the invention is to provide a secondary diaper - restraint structure which can be used with infants seated in a high chair or the like to restrain the infants from slipping out of the high chair, and concurrently provide a backup secondary diaper for the infant.

A further object of the invention is to provide a body restraint device which can be easily cleaned, and can be utilized, with adjustment of dimension, on any size or type of chair, but which can be folded up, no matter what its size, into a small compact shape so as to be susceptible to placement in a handbag, briefcase or the like without difficulty.

Additional objects and advantages of the invention will become apparent from a reading of the following detailed description in which a preferred embodiment of the invention is described, and the ensuing consideration of that embodiment, as so described, in conjunction with the accompanying drawings which illustrate that embodiment of the invention.

GENERAL DESCRIPTION OF THE DRAWINGS

FIG. 1 is a plan view of the body restraint device of the invention.

FIG. 2 is a plan view of the body restraint device of the invention as it appears after the first folding step has been carried out toward converting the body restraint device from a flat status, as shown in FIG. 1, to a body restraint status. Here the trapezoidally-shaped crotch section has been folded into a position where it can extend around the crotch and abdomen of an infant or other person to be restrained.

DETAILED DESCRIPTION OF A PREFERRED EMBODIMENT OF THE INVENTION

Figure 1:
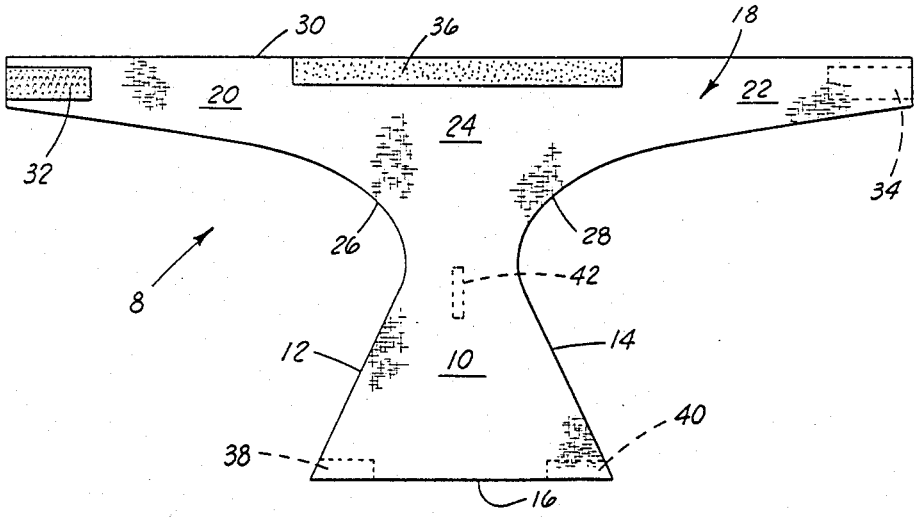

The body restraint device is designated generally by reference numeral 8, and in the illustrated embodiment, includes a trapezoidally-shaped fabric crotch protion denominated generally by reference numeral 10. The crotch portion 10 includes a pair of convergent side edges 12 and 14, and an elongated securing edge 16 which extends between, and intersects the side edges 12 and 14. The elongated securing edge 16 extends parallel to the longitudinal axis of a waistband which is joined at its center to the crotch portion and is doniminate generally by reference numeral 18. The waistband 18 includes a pair of elongated wings 20 and 22 which are joined end-to-end through the central portion 24 of the waistband of the restraint device.

The trapezoidally-shaped crotch portion is joined to the elongated waistband wings 20 and 22 through a pair of radiused edge portions 26 and 28. The waistband 18 terminates in a free upper edge portion 30. On one side of the end of the elongated waistband wing 20, a Velcro tab 32 of either the hook or the loop-type is sewn, adhered or otherwise suitably secured to the surface of the fabric of which the restraint device is constructed. At the end of the other of the waistband wings 22, a similar Velcro patch or tab 34 is secured to the opposite side of the panel of material from which the restraint device is formed so as to face in the opposite direction from its direction in which the patch or tab 32 of Velcro material faces. The tabs 32 and 34 of Velcro material engage each other when the restraint device is in use on the manner shown in FIGS. 3 and 4. One of these two Velcro tabs 32 or 34 will be of the hook-type material, and the other will be the loop-type material, so that adherence of the tabs to each other can be effectively accomplished.

At the central portion 24 of the waistband 18, on the inner side thereof, and immediately adjacent and aligned with the upper edge 30 thereof is an elongated band 36 of Velcro material. At the opposite corners of the crotch portion 10 immediately adjacent the elongated securing edge 16 and on the outer side of the material, a pair of Velcro material is made of either hook or loop-type Velcro material, whereas the patches or tabs 38 and 40 adjacent the securing edge 16 are made of the opposite or different type of material so that engagement can be effected. A safety loop 42 is secured to the panel of flexible fabric material on the outerr side thereof, and is located near the location where the crotch portion 10 intersects the waistband 18.

USE AND OPERATION

To use the body restraint of the invention, the panel of material of which it is constructed is first placed flatly in a seat where the person whose body is to be restrained will be seated. For illustrative purposes, an infant is shown in a restrained status in FIG. 4 of the drawings. The restraint device is placed in the chair with the other side of the crotch portion 10 disposed against the upper surface of the seat. At this time, the waistband 18 is toward edge of the seat, and the securing edge 16 is folded upwardly along the back of the seat to approximately the height at which will be located the waist of the person whose body is to be restrained in the seat.

It should be understood that the body restraint device of the invention can be used on very small infants, as well as on larger children, and even on adult persons, who by reason of advanced years, or some mental or physical incontinence which has caused control of the motor functions of the body to be deleteriously affected, have difficulty in remaining seated in an upright position. These, persons, too, may be effectively restrained by the restraint device. The configuration and operating principles of the device remain the same, and it is only necessary to scale the device up in size to accommodate a relatively larger person.

When the body restraint device has been positioned on the chair or other location where the person is to sit and be restrained, the person is then seated in the chair so that the wider portion of the crotch portion 10 extends across the buttocks and up along the rear of the body adjacent the lower part of the spine. As previously indicated, the securing edge 16 will then extend across the back of the seated person at a location which is opposite the waist of the person (at about the small of the back). At this time, the waistband 18 is pulled up until the upper edge 30 extends along the waistline of the person.

Figure 3:
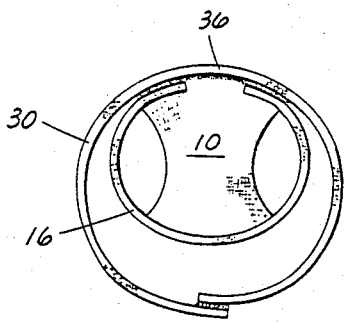
FIG. 3 is a plan view of the body restraint device after it has been fully folded into its operative restraining position.
Figure 4:
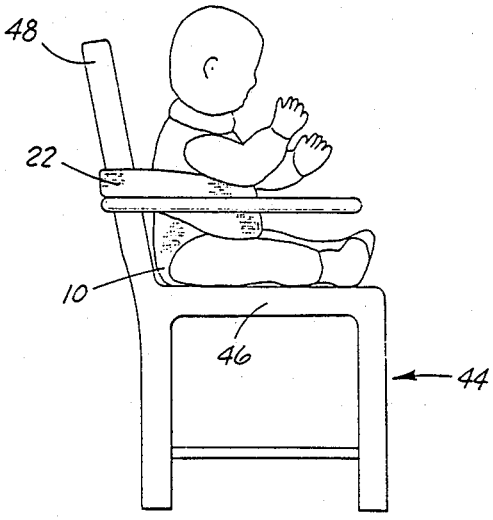
FIG. 4 is a side elevation view showing the body restraint device in use for restraining an infant in a high chair.

After the waistband 18 has been pulled up to the position described, in which the central portion 24 thereof extends across the abdomen, the corners of the crotch portion 10 which are adjacent the securing edge 16 are brought forward and around so that the upper portion of the crotch portion moves into a circular configuration as shown in FIG. 3. The Velcro tabs 38 and 40, by reason of their having been curved around the body then face toward the Velcro band 36, and can be secured thereto in the manner shown in FIG. 3. At this point, the crotch portion 10 and the central portion 24 of the waistband 18 surround the abdomen, hips and lower spine of the body of the person restrained.

The waistband wings 20 and 22 are next pulled around the body of the person outside of the crotch portion 10 which is then adjacent the buttocks and lower spine of the seated person. The wings 20 and 22 are then further extended to pass around the back of the chair in which the person is seated. In the example depicted in FIG. 4, the chair is denominated by reference numeral 44, and it includes a seat 46 and an upwardly extending back 48.

When the elongated waistband wings 20 and 22 have been passed around behind the back 48 of the chair 44, the ends of these wings are overlapped. The wings 20 and 22 can then be interlocked by contact of the Velcro tabs in the manner illustrated in FIG. 3.

Figure 2:
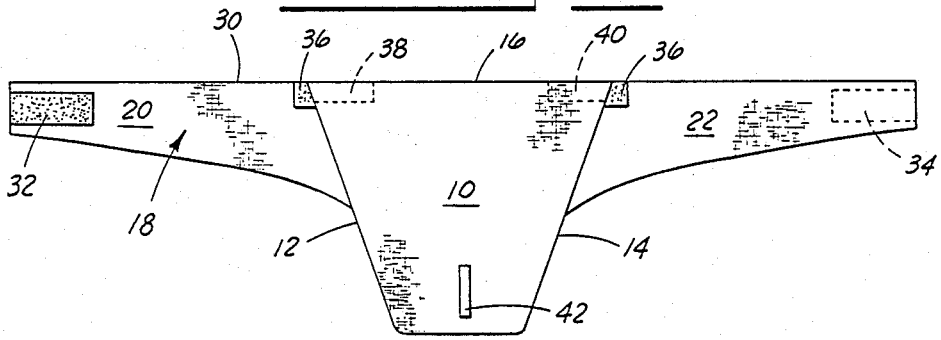

As shown in FIG. 2, at the time that the crotch portion is brought around and the tabs 38 and 40 are engaged with the band 36, the safety loop 42 is exposed at a location which will be just above the upper surface of the seat of the chair and immediately adjacent the back 48 of the chair. At this time, the user of the body retraint device can, if such precaution should be desired, secure a restraining strap or flexible lead to the safety loop 42 and to the back 48 of the chair 44. This provides additional safety of retention of the body of the person sitting in the chair in the event that the wings 20 and 22 of the waistband 18 should become detached from each other, and thus, permit the waistband to become detached from the back of the chair.

Although certain preferred embodiments of the invention have been herein described, it will be understood that various changes and innovations of the invention can be effected without departure from the basic operating principles which have been described. Changes of this type are deemed to be circumscribed by the spirit and scope of the invention, except as the same may be necessarily limited by the appended claims or reasonable equivalents thereof.

What is claimed is:

1. A body restraint device for preventing a person from sliding downwardly from a sitting position toward a prone position comprising.

a flexible waistband having an inner side and an outer side and including a pair of oppositely extending wings joined end-to-end to each other through a central portion of the waistband and each having a free end at the end thereof opposite said central portion, said waistband terminating in an elongated upper edge;

a flexible trapezoidally-shaped crotch portion having an inner side and an outer side and including an elongated edge extending parallel to said elongated upper edge of said waistband, and having a pair of opposed, convergent side edges, said crotch portion being joined at its narrowest part to said central portion of said waistband, and said crotch portion and waistband collectively forming a generally T-shaped, flexible monoplanar panel having an inner side and an outer side;

a pair of first fastener devices secured to the outer side of said trapezoidally-shaped crotch portion and including one of said first fastener devices adjacent each of the opposite ends of said elongated edge;

means secured to the inner side of said waistband adjacent said central portion for engaging said pair of first fastener devices so that said elongated edge of said crotch portion and a portion of said waistband upper edge form a generally circular configuration; and means for adjustably interconnecting the free ends of said waistband wings so that said waistband forms a restraining enclosure.

2. A body restraint device as defined in claim 1 wherein the crotch portion and said waistband of said body restraint device are a single piece of fabric.

3. A body restraint device as defined in claim 1 wherein each of said first fastener devices is a tab of a material having hooks or hook-engaging loops projecting therefrom, and wherein said engaging means comprises at least one band of a material having hooks or loop-engaging loops projecting therefrom as needed for engaging said first fastener devices by a hook and loop engagement.

4. A body restraint device as defined in claim 1 wherein said means for adjustably interconnecting the free ends of said waistband wings comprises a first strip of material having hook-engaging loops thereon the free end of one of said waistband wings, a second strip material having hooks thereon on the free end of the other of said waistband wings.

5. A body restraint device as defined in claim 2 wherein each of said first fastener devices is a tab of a material having hooks or hook-engaging loops projecting therefrom, and wherein said engaging means comprises at least one band of a material having hooks or loop-engaging loops projecting therefrom as needed for engaging said first fastener devices by a hook and loop engagement.

6. A body restraint device as defined in claim 2 wherein said means for adjustably interconnecting the free ends of said waistband wings comprises a first strip of material having hook-engaging loops, thereon on the free end of one of said waistband wings, a second strip of material having hooks thereon on the free end of the other of said waistband wings.

7. A body restraint device as defined in claim 5 wherein said means for adjustably interconnecting the free ends of said waistband wings comprises a first strip of material having hook-engaging loops thereon on the free end of one of said waistband wings, a second strip of material having hooks thereon on the free end of the other of said waistband wings.

8. A body restraint device as defined in claim 3 wherein said means for adjustably interconnecting the free ends of said waistband wings comprises a first strip of material having hook-engaging loops thereon on the free end of one of said waistband wings, a second strip of material having hooks thereon on the free end of the other of said waistband wings.

* * * * *

UNITED STATES PATENT AND TRADEMARK OFFICE

CERTIFICATE OF CORRECTION

PATENT NO. : 4,834,459

DATED : May 30, 1989

INVENTOR(S) : Jamie S. Leach

It is certified that error appears in the above-identified patent and that said Letters Patent is hereby corrected as shown below:

In the Specification:

In Column 1, line 32, delete "abodomen" and insert -abdomen-.

In Column 2, line 8, delete "corners" and insert -corner-.

In Column 2, line 39, after the word "securement to", insert -a-.

In Column 4, line 12, delete "protion" and insert -portion-.

In Column 4, line 19, delete "doniminate" and insert -denominated-.

In Column 4, line 35, delete "its" and insert -the-.

In Column 4, line 50, after the words "a pair of Velcro" insert -patches or tabs 38 and 40 are secured. The band 36 of Velcro-.

In Column 4, line 55, delete "outerr" and insert -outer-.

In Column 4, line 68, after the word "toward" insert -the-.

In the Claims:

In Column 6, line 61, after the word "thereon" insert -on-.

In Column 6, line 62, after the last word in the sentence "strip", insert -of-.

Signed and Sealed this

Thirtieth Day of April, 1991

*Attest:*

*Attesting Officer*

HARRY F. MANBECK, JR.

*Commissioner of Patents and Trademarks*